US008821353B2

(12) United States Patent
Lizama et al.

(10) Patent No.: US 8,821,353 B2
(45) Date of Patent: Sep. 2, 2014

(54) SWIMMING SUPPORT STRUCTURE

(75) Inventors: Mauricio A. Lizama, San Juan, PR (US); Diego A. Agostini, San Juan, PR (US)

(73) Assignee: University of Puerto Rico, San Juan, PR (US)

( * ) Notice: Subject to any disclaimer, the term of this patent is extended or adjusted under 35 U.S.C. 154(b) by 240 days.

(21) Appl. No.: 13/344,046

(22) Filed: Jan. 5, 2012

(65) Prior Publication Data

US 2013/0178341 A1 Jul. 11, 2013

(51) Int. Cl.
*A63B 21/00* (2006.01)

(52) U.S. Cl.
USPC ..... 482/55; 482/35; 482/36

(58) Field of Classification Search
USPC ..... 482/35, 23, 111, 34, 36, 38, 41, 55
See application file for complete search history.

(56) References Cited

U.S. PATENT DOCUMENTS

| | | | | | |
|---|---|---|---|---|---|
| 860,617 | A * | 7/1907 | Berglund | ..... | 84/140 |
| 2,690,789 | A * | 10/1954 | Zadrozny | ..... | 482/42 |
| 5,033,735 | A * | 7/1991 | Erickson | ..... | 482/39 |
| 6,033,351 | A * | 3/2000 | Sizemore et al. | ..... | 482/111 |
| 7,785,233 | B1 * | 8/2010 | Moore | ..... | 482/15 |

* cited by examiner

*Primary Examiner* — Jerome W Donnelly
(74) *Attorney, Agent, or Firm* — Hoglund & Pamias, P.S.C.; Roberto J. Rios

(57) ABSTRACT

The invention provides a mobile structure that can be used in any water body having a relatively uniform floor and a calm surface (i.e., beach, lake or pool). This structure has multiple hold and leaning surfaces and/or elements that lie flush and below the water level providing people with disabilities and older people a solid support structure to hold, sit, stand or lean while performing adapted swimming activities.

14 Claims, 7 Drawing Sheets

SWIMMING SUPPORT STRUCTURE

BACKGROUND OF THE INVENTION

Adapted swimming is an excellent therapeutic and recreational option for people with disabilities, older people and people with motor difficulties. For that reason, there is a need to provide a secure and protected structure where a person could lean or hold while performing any aquatic activity. However, there is no such structure available at a beach and a person with disability is limited to use floating devices or if physically capable, the person could hold to a buoy or cords that do not provide the necessary static support and security required. Even at a pool, the only solid structural support available is limited to its borders, were a person can't achieve an optimum hold needed to perform adapted swimming and his/her positioning options are very limited (i.e., in front or against a side wall).

SUMMARY OF THE INVENTION

The present invention is a mobile structure that can be used in any water body having a relatively uniform floor. According to an aspect of the invention, the structure has multiple hold and leaning surfaces and/or elements that lie flush and below the water level providing people with disabilities and older people a solid support structure to hold, sit, stand or lean while performing adapted swimming activities.

The present invention is intended not only for people with disabilities but for people that do not know how to swim, children learning how to swim or any other person that feels insecure in the water by using the support structure to float, swim or even dive.

According to another aspect of the invention, the support structure preferably comprises a plurality of PVC pipes with a perpendicular base forming inverted T-shaped supports.

According to a further aspect of the invention, these pipes are interconnected by means of transversal PVC pipe pairs of smaller diameter to facilitate holding. Each pair of connecting pipes extend in parallel between the plurality of PVC pipes so that one of them lies flush with the water level and the other lies below water level at a distance appropriate for a person to sit on it while maintaining the head above the water level.

According to another aspect of the invention, the transversal pipes are height adjustable with respect to the supporting pipes, allowing installation of the structure to inclined surfaces or irregular depths.

According to one aspect of the invention, the most basic configuration of the support structure comprises 3 pipes joined by the transversal pipes forming a triangular shape. This distribution maximizes the structural stability of the system by preventing the structure from tipping over by the lateral forces applied at different points of the structure.

According to another aspect of the invention, the structure is completely modular so that it can be installed in a variety of configurations that accommodate to the amount of users, type of activity, distance between and instructor and users and desired privacy among others.

According to still another aspect of the invention, the system can be provided with rigid or semi-rigid seats, flags, audible indicators, drink holders, flotation equipment and water-proof illumination attached to the pipes among others.

BRIEF DESCRIPTION OF THE DRAWINGS

Further features and advantages of the invention will become apparent from the following detailed description taken in conjunction with the accompanying figures showing illustrative embodiments of the invention, in which.

Throughout the figures, the same reference numbers and characters, unless otherwise stated, are used to denote like elements, components, portions or features of the illustrated embodiments. The subject invention will be described in detail in conjunction with the accompanying figures, in view of the illustrative embodiments.

DESCRIPTION OF THE INVENTION

The proposed invention comprises a mobile structure that can be used in any water body having a relatively uniform floor and a calm surface (i.e., beach, lake or pool). This structure has multiple hold and leaning surfaces and/or elements that lie flush and below the water level providing people with disabilities and older people a solid support structure to hold, sit, stand or lean while performing adapted swimming activities. The present invention is intended not only for people with disabilities but for people that do not know how to swim, children learning how to swim or any other person that feels insecure in the water by using the support structure to float, swim or even dive. Individuals with severe mobility limitations such as: spinal cord injury, multiple sclerosis, muscular dystrophy, cerebral trauma, cerebral-vascular injury, cerebral palsy, and amputations constitute the main group which will benefit from this invention and where the benefits in terms of aquatherapy and adapted swimming are more evident.

Figure 1:
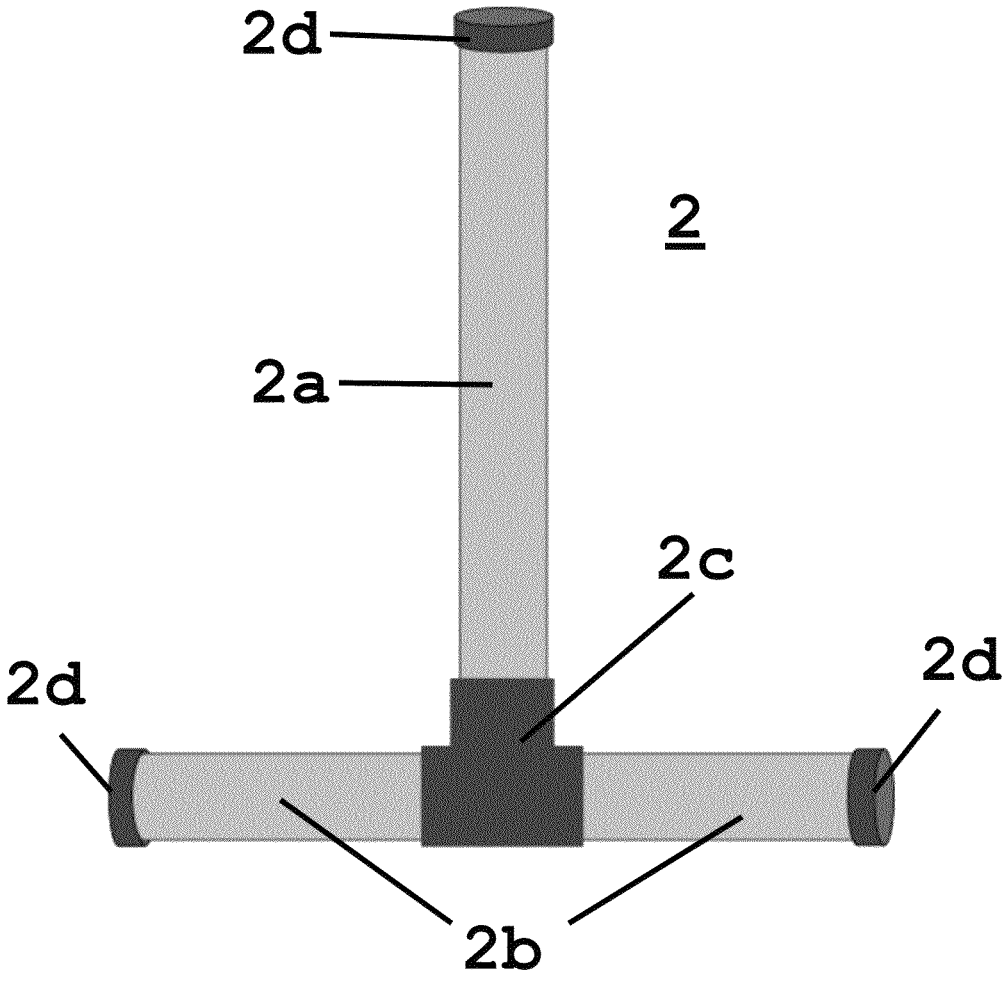
FIG. 1 shows a base support post according to the present invention.

The swimming support structure of the invention comprises a plurality of pipes with a perpendicular base forming inverted T-shaped supports as shown in FIG. 1. The base 2 comprises a substantially horizontal pipe 2*b* structurally attached to a perpendicular pipe 2*a* by means of a union 2*c*. Pipes 2*a* and 2*b* are easily removed apart from the union 2*c* for ease of transportation or storage.

Figure 2:
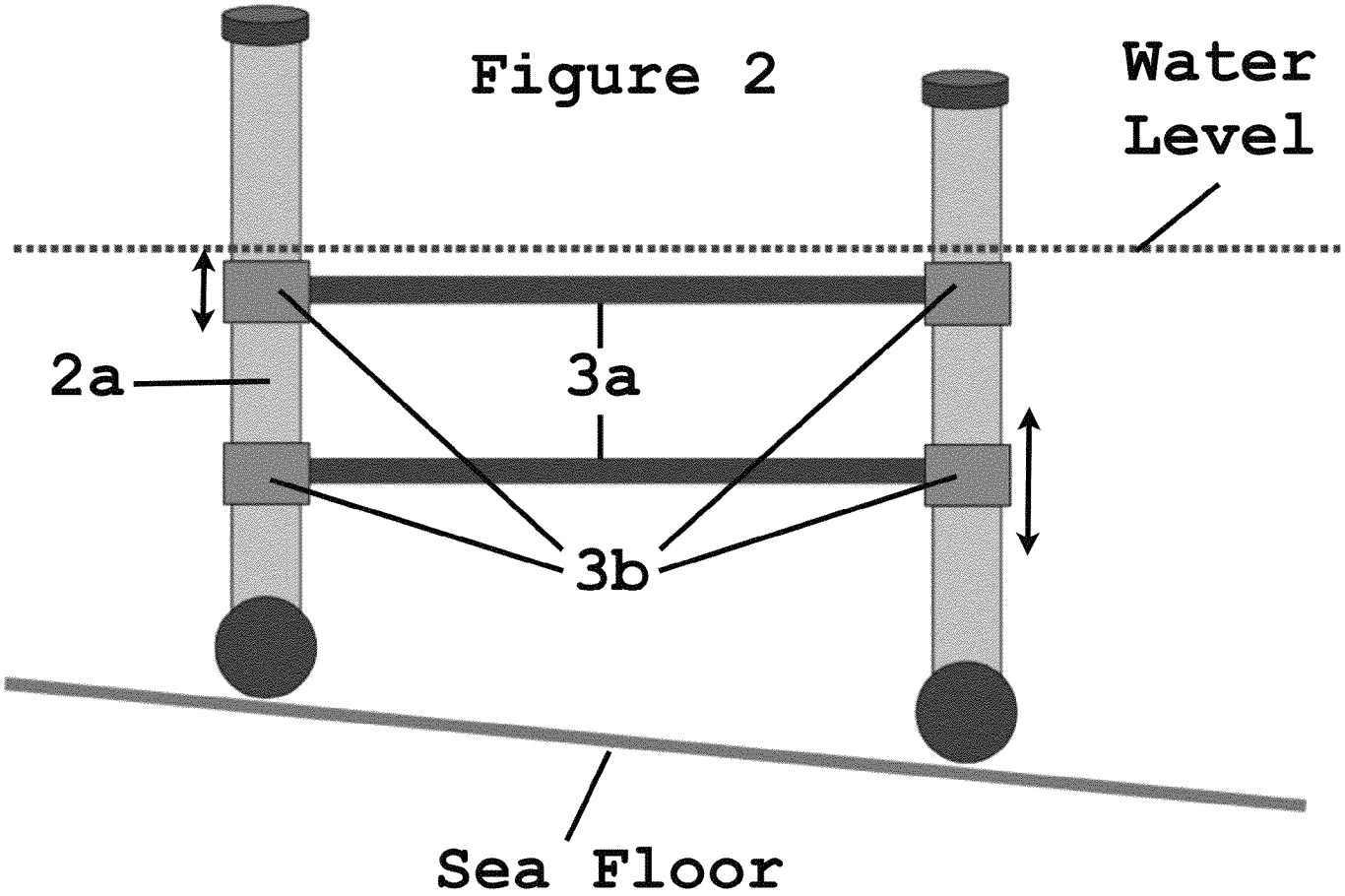
FIG. 2 shows a transversal post connection according to the present invention.

Plural bases 2 are interconnected by means of a pair of transversal pipes 3*a* of smaller diameter that facilitate holding and stability between them. Each pair of connecting pipes extend in parallel between the plurality of bases 2 and are attached to said bases by means of clamps 3*b* as shown in FIG. 2. Transversal pipes 3*a* can be easily removed from said clamps 3*b* for ease of transportation or storage. In an embodiment of the invention, transversal pipes 3*a* are selectively configured so that one of them lies substantially flush with the water level and the other lies below water level at a distance appropriate for a person to sit on it while maintaining the head above the water level. Thus, according to the invention the transversal pipes 3*a* are height adjustable with respect to the water level and/or the sea floor by selectively sliding clamps 3*b* along the length of pipes 2*a*, allowing adapting the structure to inclined surfaces or irregular depths as shown in FIG. 2.

Figure 3:
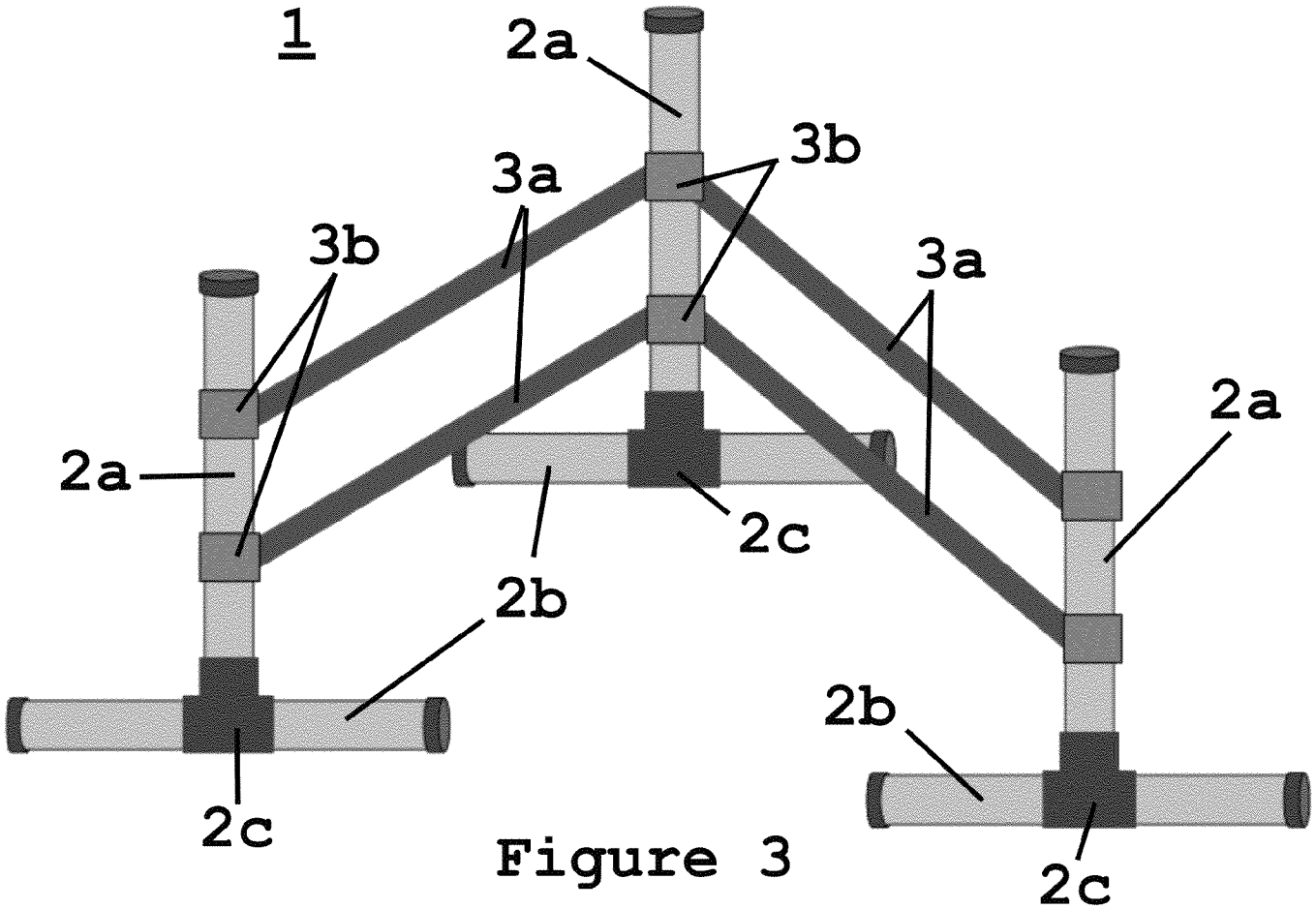
FIG. 3 shows a basic swimming support structure layout according to the present invention.

In its most basic configuration, the support structure of the present invention comprises three bases 2 joined by the transversal pipes 3*a* forming a triangular shape as shown in FIG. 3. This distribution maximizes the structural stability of the system by preventing the structure from tipping over by the lateral forces applied at different points of the structure. In a preferred embodiment, the system is sold as a basic kit having all the parts as shown in FIG. 3. Additional parts can be acquired separately.

Figure 4:
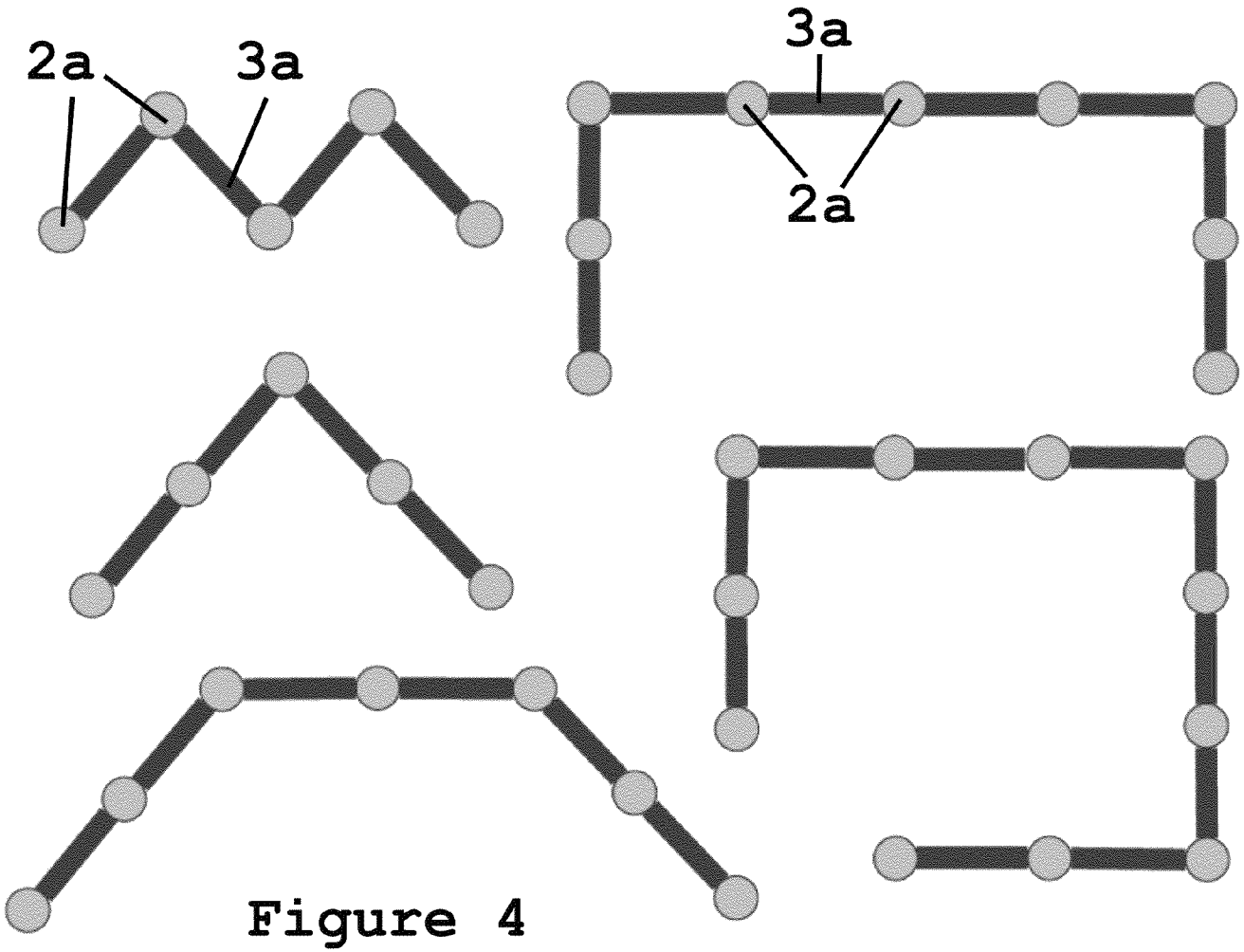
FIG. 4 shows alternate swimming structure layouts according to the present invention.
Figure 5:
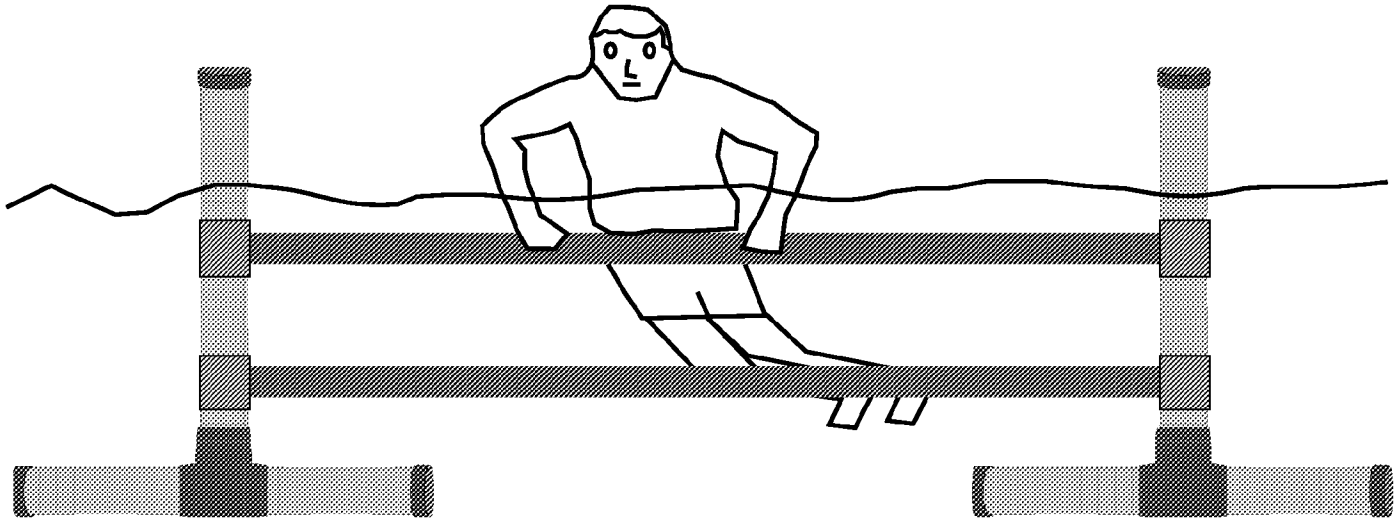
FIG. 5 shows the swimming support structure in operation according to the present invention.

In operation, a user would install the system by inserting the appropriate pipes 2*a*, 2*b* into union 2*c* to form the base 2 as shown in FIG. 1. The user repeats this process to as necessary to have all the necessary bases 2 to form any desire configuration as shown in FIG. 3 and FIG. 4. Clamps 3*b* are already installed on pipe 2*a* or alternatively the user could attach them manually. Then, the user proceeds to insert a pair of transversal pipes 3*a* into the clamps 3*b* of adjacent bases 2 as shown in FIG. 2 and FIG. 3. This process is repeated as many times as needed to form any desired configuration as shown in FIG. 3 and FIG. 4. As previously explained, transversal pipes 3*a* are slidably adjusted on said pipe 2*a* in relation to the sea floor surface to ensure that the upper transversal pipe 3*a* remains substantially at water level and that the lower transversal pipe 3*a* remains at a level where a user could seat comfortably. FIG. 5 shows one practical use of the swimming structure according to the present invention.

The structure of the present invention is completely modular so that it can be installed in a variety of configurations that accommodate to the amount of users, type of activity, distance between instructor and users and desired privacy among others as shown in FIG. 4. For security purposes, the pipes may include diagonal cords and buoys to mark the location and limits of the supporting bases so that the users avoid undesired contact with the bases and have a clear indication of the provided limits.

Figure 6:
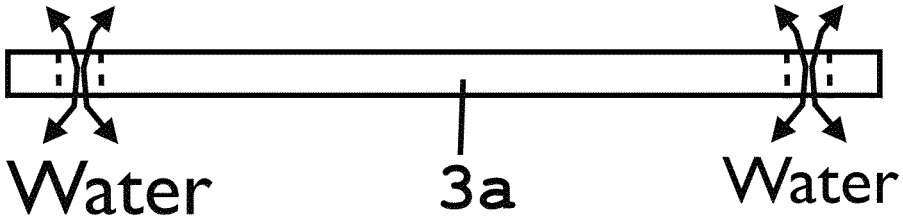
FIG. 6 shows a transversal pipe according to the present invention.
Figure 7:
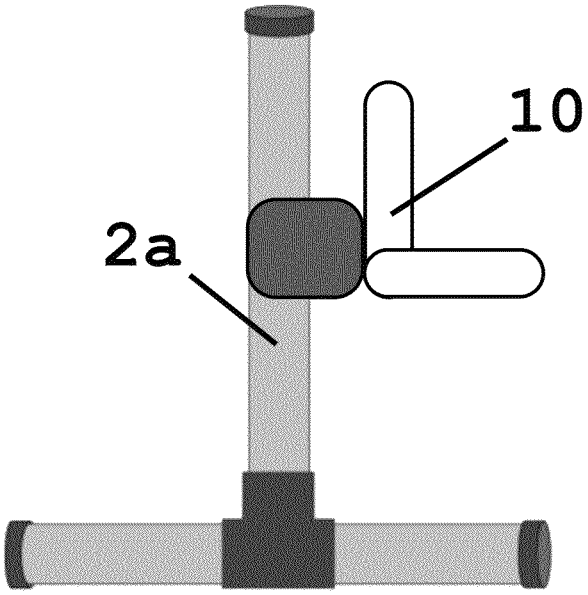
FIG. 7 shows a base support post with a seating arrangement according to the present invention.
Figure 8:
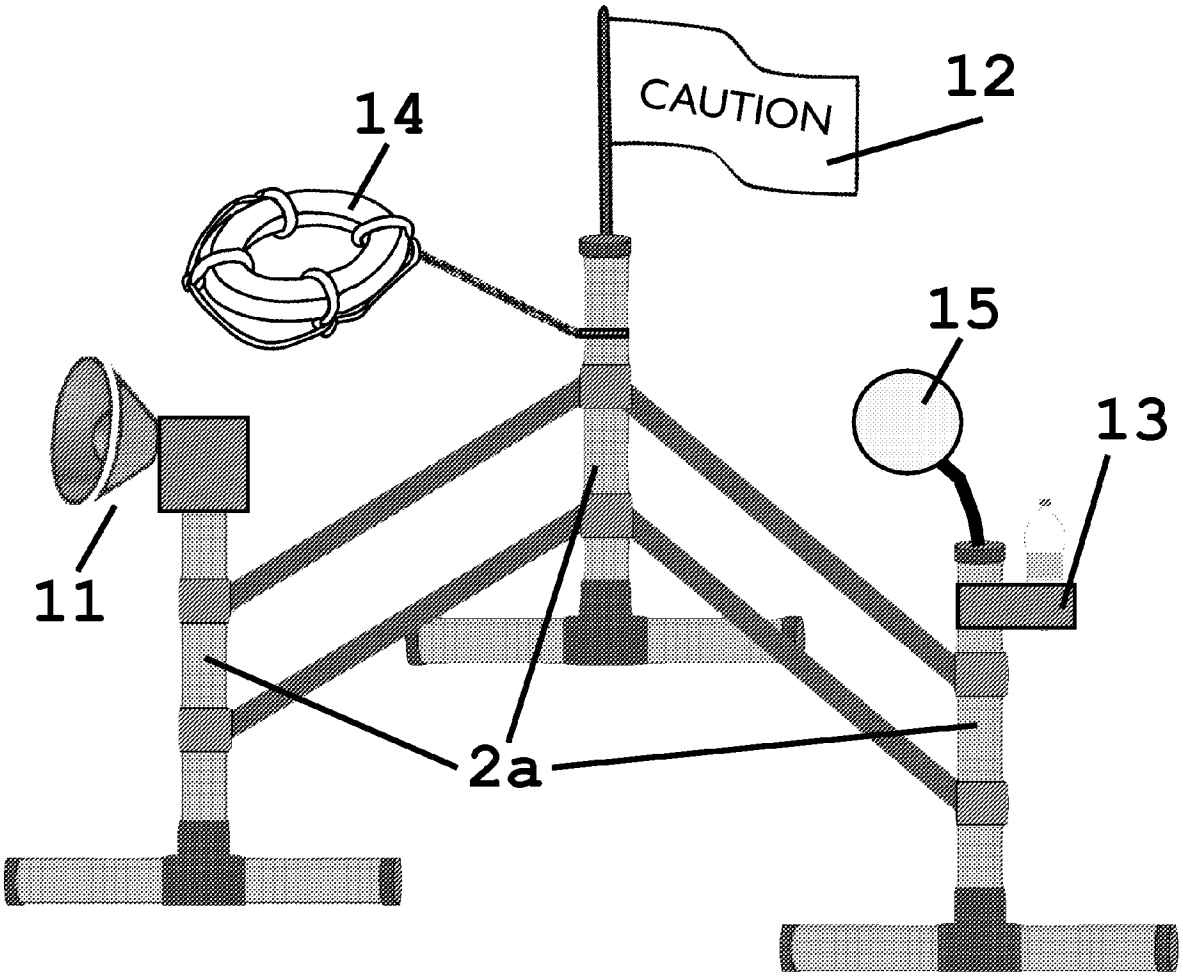
FIG. 8 shows a swimming support structure according to the present invention.

The pipes 2*b* and the superior portion of the pipes 2*a* include threaded lids 2*d* as shown in FIG. 1 that facilitate transportation and installation in any desired place. For example, before entering the swimming structure into the water the lids 2*d* can be closed while the pipes are filled with air to facilitate flotation and movement of the structure to a desired location inside the water. Once the desired location is reached, the lids 2*d* are removed allowing the water to enter the pipe and forcing the pipe structure to submerge until it reaches the supporting floor surface. Alternatively, the pipes could be filled with a filling material such as but not limtied to sand to increase the weight of the system and increase its structural stability if necessary. When removing the water from the equipment, the lids 2*d* can be removed to get rid of the sand and facilitate its transportation. The transversal pipes 3*a* have small openings on the upper and lower portions of each end to allow the free flow of water when submerging and removing the equipment from the water as shown in FIG. 6. The lower transversal pipes of the equipment can be used to stand of sit directly on them. However, rigid or semi-rigid seats 10 can also be attached to the pipes for providing better support to users with poor torsal control as shown in FIG. 7. These pipes are also used to hold in place the legs of a user with paraplegia or quadriplegia avoiding unvoluntary floating causing to user to be in an undesired position inside the water like facing down. Alternatively, several accessories can be attached to the equipment such as flags 12 to visually identify the location of the structure, audible indicators 11, drink holders 13, and flotation equipment 14 among others as shown in FIG. 8. Straps can also be used to provide upper and lower extremities with proper support according to individual needs of the users. Removable water-proof illumination 15 is also provided to ensure proper visibility during night or dark environments.

Although the present invention has been described herein with reference to the foregoing exemplary embodiment, this embodiment does not serve to limit the scope of the present invention. Accordingly, those skilled in the art to which the present invention pertains will appreciate that various modifications are possible, without departing from the technical spirit of the present invention.

We claim:

1. A swimming support structure for people with disabilities comprising:

a plurality of support bases, each support base comprising a horizontal element configured to contact a floor of a body of water; a verical element attached to said horizontal element extending upwardly from said horizontal element and a union element configured to removably receive said horizontal element and said verical element to form a T-shaped support base;

one pair of transversal elements extending between two support bases of said plurality of support bases and configured to be removably attached from the vertical elements of said two support bases, respectively, each of said transversal elements being configured to selectively adjust its height with respect to the water level of said body of water independent from the other.

2. The swimming support structure of claim 1 further comprising:

a clamping element having an attaching portion configured to be removably attached to said vertical element and at least one receiving portion configured to receive one end of a transversal element.

3. The swimming support structure of claim 2, wherein said clamping element is configured to longitudinally slide on said vertical element so that said transversal element adjust its height with respect to the water level of said body of water.

4. The swimming support structure of claim 1, wherein said pair of transversal elements comprises an upper transversal element and a lower transversal element, said upper transversal element being configured to be positioned at a distance closer to the water level of said body of water than the distance of said lower transversal element.

5. The swimming support structure of claim 1, wherein said pair of transversal elements comprises at least one opening that allows the free flow of water when attached to said vertical elements.

6. The swimming support structure of claim 1, wherein at least one of said horizontal element and said vertical element comprises a hollow interior portion selectively sealed by a removable lid.

7. The swimming support structure of claim 1, further comprising a seating arrangement removably attached to said swimming support structure.

8. The swimming support structure of claim 1, further comprising an audible device removably attached to said swimming support structure.

9. The swimming support structure of claim 1, further comprising a visual indicia removably attached to said swimming support structure.

10. The swimming support structure of claim 1, further comprising an illumination element removably attached to said swimming support structure.

11. The swimming support structure of claim 1, further comprising a container holding lelement removably attached to said swimming support structure.

12. The swimming support structure of claim 1, further comprising a floating element removably attached to said swimming support structure.

13. The swimming support structure of claim 2, wherein said clamping element is further configured to selectively rotate around said vertical element allowing to interconnect at least three support bases of said plurality of support bases so that said at least three support bases in conjunction with their respective transversal elements form a desired shape.

14. A swimming support structure kit comprising:

a first vertical element and a second vertical element;

a first horizontal element and a second horizontal element;

a first T-shaped union element having a first upper receiving opening configured to receive one end of said first vertical element and a first side receiving opening configured to receive one end of said first horizontal element;

a second T-shaped union element having a second upper receiving opening configured to receive one end of said second vertical element and a second side receiving opening configured to receive one end of said second horizontal element;

a first transversal element;

a second transversal element;

a first clamping element having a first attaching portion configured to be strucutrally attached to a portion of said first vertical element and a first transversal receiving opening configured to receive one end of said first transversal element;

a second clamping element having a second attaching portion configured to be strucutrally attached to a portion of said second vertical element and a second transversal receiving opening configured to receive the other end of said first transversal element;

a third clamping element having a third attaching portion configured to be strucutrally attached to a portion of said first vertical element and a third transversal receiving opening configured to receive one end of said second transversal element; and a fourth clamping element having a fourth attaching portion configured to be strucutrally attached to a portion of said second vertical element and a fourth transversal receiving opening configured to receive the other end of said second transversal element.

* * * * *